US008408215B2

(12) United States Patent
Libbra et al.

(10) Patent No.: US 8,408,215 B2
(45) Date of Patent: Apr. 2, 2013

(54) FILTER MAKING APPARATUS

(75) Inventors: Roberto Libbra, Bologna (IT); Fabio Cantieri, Bologna (IT)

(73) Assignee: Philip Morris USA Inc., Richmond, VA (US)

( * ) Notice: Subject to any disclaimer, the term of this patent is extended or adjusted under 35 U.S.C. 154(b) by 601 days.

(21) Appl. No.: 12/426,565

(22) Filed: Apr. 20, 2009

(65) Prior Publication Data

US 2009/0260643 A1 Oct. 22, 2009

(30) Foreign Application Priority Data

Apr. 18, 2008 (EP) ..... 08154801

(51) Int. Cl.
*A24D 3/02* (2006.01)

(52) U.S. Cl. ..... 131/77; 131/84.1; 131/84.3; 131/335; 131/274

(58) Field of Classification Search ..... 131/200, 131/274, 275, 335, 344, 70, 285, 77–78, 131/84.1–84.3
See application file for complete search history.

(56) References Cited

U.S. PATENT DOCUMENTS

| | | | | |
|---|---|---|---|---|
| 884,982 | A | 4/1908 | De Lery | |
| 3,016,945 | A * | 1/1962 | Wexler | 156/200 |
| 3,050,430 | A * | 8/1962 | Gallagher | 156/166 |
| 3,068,873 | A | 12/1962 | Allman, Jr. et al. | |
| 3,144,024 | A | 8/1964 | Eichwald et al. | |
| 3,162,199 | A | 12/1964 | Moll, Jr. | |
| 3,313,306 | A | 4/1967 | Berger et al. | |
| 3,339,558 | A | 9/1967 | Waterbury | |
| 3,397,700 | A | 8/1968 | Harlow et al. | |
| 3,422,819 | A | 1/1969 | Jones et al, | |
| 3,546,325 | A | 12/1970 | Muller | |
| 3,637,447 | A | 1/1972 | Berger et al. | |
| 3,683,936 | A | 8/1972 | O'Neil, Jr. | |
| 3,779,787 | A * | 12/1973 | Haslam et al. | 427/290 |
| 3,837,264 | A | 9/1974 | Sexstone | |

(Continued)

FOREIGN PATENT DOCUMENTS

| | | |
|---|---|---|
| EP | 0 128 031 A2 | 12/1984 |
| EP | 0 573 279 A1 | 12/1993 |

(Continued)

OTHER PUBLICATIONS

European Search Report dated Sep. 30, 2008, Application No. EP 08 15 4801.

*Primary Examiner* — Jodi C Franklin
(74) *Attorney, Agent, or Firm* — Buchanan Ingersoll & Rooney PC

(57) ABSTRACT

The invention concerns a filter making apparatus comprising: a filter material converging device, a flavor element positioning device comprising a passage element, the passage element comprising a passageway, a first inlet, a second inlet, and an outlet, the first inlet and second inlet being in fluid communication with the passageway, wherein the first inlet is adapted to pass a continuous strand of material into the passage element, wherein the second inlet is adapted to pass fluid into the passage element, and wherein the outlet is positioned at a point downstream from at least a portion of the filter material converging device, wherein the passage element is adapted to pass through the second inlet and into the filter material either the continuous strand of material from the first inlet, or fluid from the second inlet, or the continuous strand of material from the first inlet together with fluid from the second inlet.

11 Claims, 4 Drawing Sheets

U.S. PATENT DOCUMENTS 3,847,064 A 11/1974 Berger
3,853,039 A 12/1974 Haslam et al.
4,034,765 A 7/1977 Hall
4,179,323 A 12/1979 Sigmon
4,189,511 A 2/1980 Levers et al.
4,211,741 A 7/1980 Ostoich
4,236,532 A 12/1980 Schweizer et al.
4,281,671 A * 8/1981 Bynre et al. ..... 131/335
4,291,711 A 9/1981 Berger
4,355,995 A 10/1982 Berger
4,522,616 A 6/1985 Hyde et al.
4,537,583 A 8/1985 Pryor
4,549,875 A 10/1985 Pryor
4,607,646 A 8/1986 Lilly, Jr. et al.
4,655,229 A 4/1987 Sensabaugh, Jr. et al.
4,661,090 A 4/1987 Arthur
4,676,769 A 6/1987 Bahr et al.
4,677,995 A 7/1987 Kallianos et al.
4,744,932 A 5/1988 Browne
4,768,526 A 9/1988 Pryor
4,798,090 A 1/1989 Heath et al.
4,798,570 A 1/1989 Jurkiewitsch
4,884,435 A 12/1989 Ehara
4,971,078 A 11/1990 Deutsch et al.
5,012,829 A 5/1991 Thesing et al.
5,076,293 A * 12/1991 Kramer ..... 131/291
5,144,967 A 9/1992 Cartwright et al.
5,190,061 A 3/1993 Brackmann et al.
5,269,329 A 12/1993 Geer et al.
5,387,285 A 2/1995 Rivers
5,415,189 A 5/1995 Sampson et al.
5,561,344 A 10/1996 Hsi
5,725,467 A 3/1998 Chehab et al.
5,845,649 A 12/1998 Saito et al.
5,892,690 A 4/1999 Boatman et al.
6,333,632 B1 12/2001 Yang et al.
6,903,555 B2 6/2005 Gill et al.
7,074,170 B2 7/2006 Lanier, Jr. et al.
2003/0224918 A1 * 12/2003 Lanier et al. ..... 493/39
2005/0224136 A1 * 10/2005 Hayes et al. ..... 141/329
2005/0255978 A1 * 11/2005 Lanier et al. ..... 493/39
2007/0107739 A1 * 5/2007 Sato et al. ..... 131/84.1

FOREIGN PATENT DOCUMENTS

WO WO 03/082558 A1 10/2003
WO WO 2006/010895 A1 2/2006
WO WO 2007/085830 A2 8/2007
WO WO 2007085830 A2 * 8/2007

* cited by examiner

FILTER MAKING APPARATUS

CROSS-REFERENCE TO RELATED APPLICATION

This application corresponds to European Patent Application No. 08 154 801, filed Apr. 18, 2008, the entire contents of which are incorporated herein by this reference thereto.

BACKGROUND

This invention relates to an apparatus for making cigarette filters that incorporate a centrally located flavored element, which affects the taste of smoke drawn through the filter.

Tobacco smoke filters have been produced that incorporate a flavor agent where the agent is applied uniformly over the filtering material before the filtering material is gathered and shaped to form the filter product. Examples of these conventional filters include a flavored tobacco smoke filter made from bonded cellulose acetate filamentary tow in which a liquid plasticizer such as triacetin is sprayed uniformly over the tow before it is gathered to its final rod form. The flavoring agent is normally dissolved in the liquid plasticizer, and the plasticizer affects the bonding between adjacent filaments.

The International application WO2006/010895 discloses an apparatus for applying an additive to cigarette filter tow material that is in, or exiting, a filter tow funnel. This apparatus comprises a flavor inlet; a valve; and a hollow needle positioned downstream of at least a portion of said filter tow funnel, the needle being in fluid communication controlled by said valve with said flavor inlet, whereby, in use, an additive is delivered by said needle into the path of said filter tow material.

BRIEF SUMMARY OF SELECTED ASPECTS OF THE INVENTION

The International application WO03/082558 discloses a filter making apparatus with a positioning device guiding a continuous flavor element such as a continuous strand of textile into the tow material before it is gathered to its final rod form. The continuous strand of textile is loaded with a flavor material shortly before its introduction into the tow.

According to the present invention a filter making apparatus is provided, the filter making apparatus comprising a filter material converging device and a flavor element positioning device. The flavor element positioning device comprises a passage element, the passage element comprising a passageway, a first inlet, a second inlet, and an outlet. The first and second inlets are in fluid communication with the passageway. The first inlet is adapted to pass a continuous strand of material into the passage element.

The second inlet is adapted to pass a fluid into the passage element. The outlet of the passage element is positioned at a point downstream from at least a portion of the filter material converging device.

According to the invention, the passage element is adapted to pass to the outlet and into the filter material either the continuous strand of material from the first inlet, or fluid from the second inlet, or the continuous strand of material from the first inlet together with fluid from the second inlet. This allows for high flexibility in the filter production. The invention is particularly suitable for the combined application of a continuous strand of material and fluid. The amount of the applied fluid is not dependent on the property of the continuous strand of material to absorb the fluid. Instead, the amount of fluid is dependent, for example, on the characteristics of the fluid and on the fluid supply means, for example a fluid pump. Thus, the application of a continuous strand of material and fluid at the same time may be performed at a higher machine speed, for example up to 600 meters per minute.

According to the invention, the continuous strand of material may be for example one or multiple threads, cotton yarns, acetate yarns, bamboo yarns or other natural, vegetable based and biodegradable yarns. Alternatively, the continuous strand of material may be one or a plurality of hollow tubes, preferably with a diameter of between about 0.5 mm and 2 mm, preferably 1 mm. The filter material may be acetate tow, crimped paper, carbon on acetate tow or similar material known in the art to be used in filters.

Preferably, the flavor element positioning device further comprises a needle, wherein the needle is attached to the outlet of the passage element. The fluid may be injected or sprayed into the material through that needle.

Preferably, the apparatus further comprises a longitudinal positioning means, wherein the longitudinal positioning means is adapted to move the passage element in a longitudinal direction, such that the tip of the needle is movable in and out of the filter material. With this movement, the tip of the needle may be positioned very accurately in the filter material. Additionally, this arrangement has the advantage, that the hole, through which the tip of the needle enters into the material, may be very tiny. This way, disruption of the moving material is kept at a minimum. This is particularly true for filters with diameters of less than 5 mm, for example so called "super slim" filters as used in conjunction with smoking articles.

Preferably, the position of the tip of the needle is near the end of the filter converging device, close to the region in which the filter material reaches its final shape. Preferably, the position of the needle is in the region of the converging device in which the diameter of the filter material is less than double the diameter of the final diameter of the filter material. More preferably, the position of the needle is in the region of the converging device in which the diameter of the filter material is in the region of between about 150 percent and about 110 percent of the final diameter of the filter material, most preferably between about 140 percent and about 120 percent.

Preferably, the apparatus further comprises a vertical positioning means, wherein the vertical positioning means is adapted to move the passage element in a vertical direction into and out of the vicinity of the filter material converging device. This feature advantageously facilitates the maintenance of the apparatus, for example the cleaning, the change of thread or yarn, or the exchange of other parts.

Preferably, the fluid is a liquid flavourant. Examples for flavourants are flavourants on alcohol base, glycol base or water base, essential oils, oleoresins, absolutes, plant concentrates, plant extracts, distillates and natural-artificial chemicals. Examples of flavourants that may be used are tobacco, bergamot, cinnamon, spearmint, peppermint, vanilla, orange, geranium extract, linalool, coffee, menthol, eucalyptus, clove, ginger and citrus. According to the invention, the flavor on the continuous strand of material may be the same as the flavor of the fluid. Alternatively, the flavor of the continuous strand of material and the flavor of the fluid may be different.

Preferably, the apparatus further comprises a heating device, wherein the heating device is adapted to heat the fluid. Preferably, the heating device is adapted to heat the fluid inside the flavor element positioning device. Preferably, the apparatus further comprises a valve remote from the flavor element positioning device, wherein the valve controls the fluid entering the passage element.

In a further embodiment, the filter making apparatus according to the invention comprises two to four flavor element positioning devices as described above. The flavor element positioning devices may be arranged at different positions along or around the filter material. For example, two, three or four parallel threads may be thus applied to the filter material. Alternatively or in addition, up to four different fluids may be applied to the filter material through the plurality of flavor element positioning devices. Preferably, the movement of this plurality of flavor element positioning devices is decoupled. Preferably, a common control for the plurality of flavor element positioning devices is provided.

The present invention also is directed to a filter element wherein the filter element is made by an apparatus according to the invention. Additionally, the present invention is directed to a smoking article with such a filter element. The smoking article may be for example a cigarette or cigarillo.

BRIEF DESCRIPTION OF THE DRAWINGS

Many objects and advantages of the present invention will be apparent to those skilled in the art when the exemplary embodiment of this specification is read in conjunction with the appended drawings wherein like reference numerals are applied to like elements and wherein.

DETAILED DESCRIPTION OF THE PREFERRED EMBODIMENTS

Figure 1:
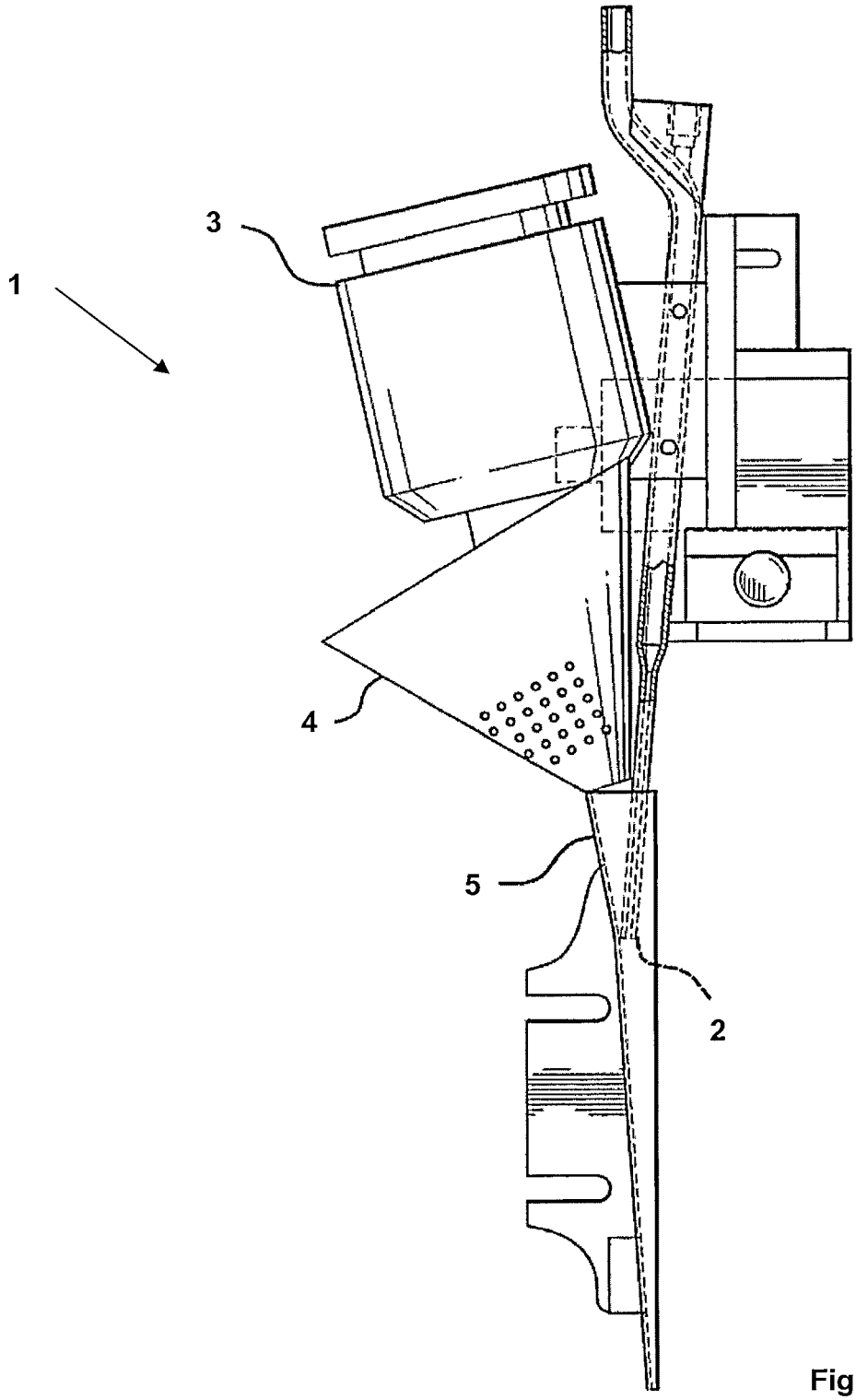
FIG. 1 depicts a filter making apparatus according to the state of the art.

FIG. 1 shows an embodiment of a positioning device 1 according to the state of the art (WO03/082558, incorporated by reference herein in its entirety). The flavor element positioning device 50 (see FIG. 3) is combined with standard filter making equipment to provide for the positioning of a flavor element that is approximately centered within a filter rod made from filter material.

Filter material such as cellulose acetate tow can be drawn from a bale and passed over a series of rollers (not shown) located upstream of the transport jet 3 before the filter tow material begins to be converged by the transport jet 3. The filter tow material is then fluffed by the injection of compressed air supplied via a suitable arrangement (not shown) to the transport jet 3. After exiting the outlet end of the transport jet, the fluffed filter tow material is then further converged by the air funnel 4 before entering under the garniture tongue 5.

The garniture tongue 5 guides converging filter tow material exiting from a transport jet 3 and air funnel 4 into a standard garniture downstream of the outlet end 2 where the filter tow is shaped to rod form. The resulting continuous rod is then wrapped with a filter paper and the wrap is secured with an overlapped and adhesively bonded seam.

Figure 2:
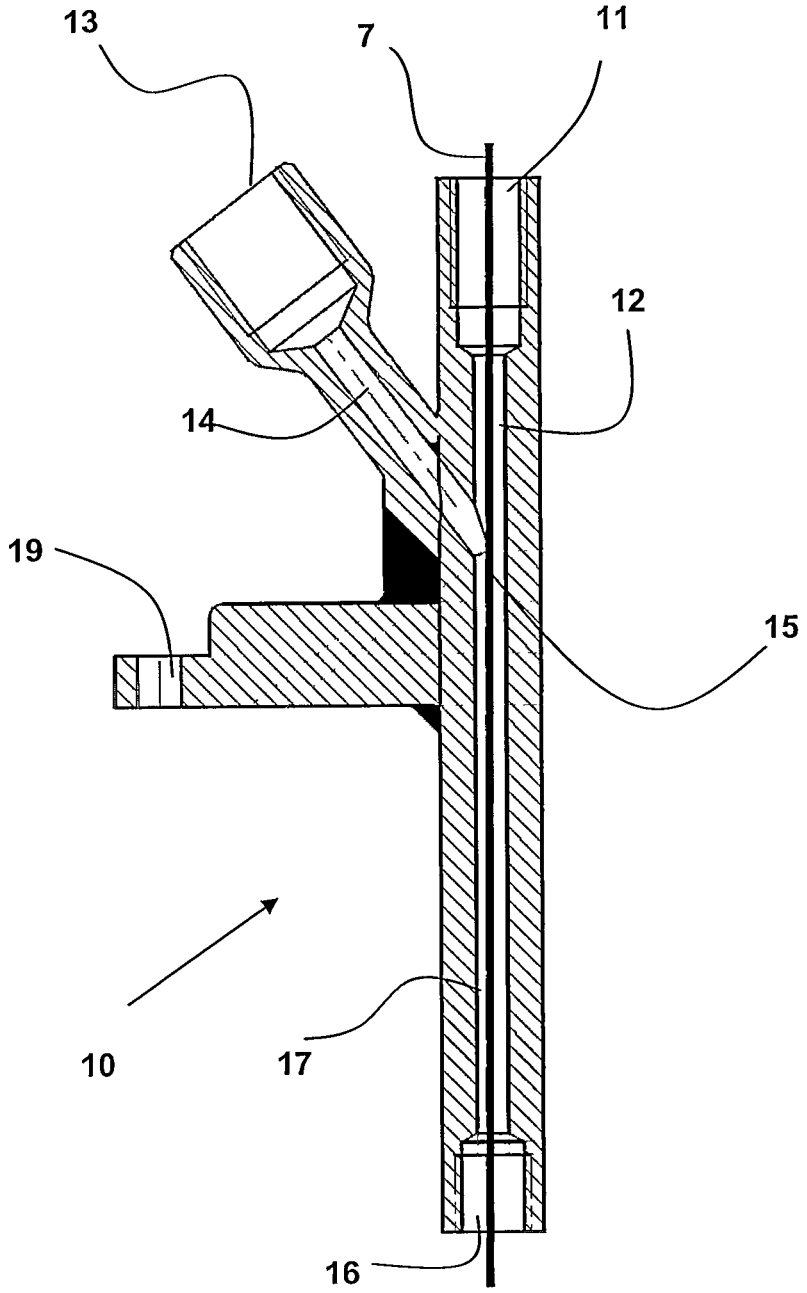
FIG. 2 illustrates a passage element of the flavor element positioning device according to an embodiment of the invention.

FIG. 2 shows the passage element 10 of the flavor element positioning device 50. The passage element 10 comprises a first inlet 11. The first inlet 11 is in fluid contact with a first fluid duct 12. The passage element 10 further comprises a second inlet 13. The second inlet 13 is in fluid contact with a second fluid duct 14. At a junction 15, the first fluid duct 12 and the second fluid duct 14 join into a passageway 17 that terminates into an outlet 16. The first inlet 11 is connectable to a supply of a strand of flavor material 7, for example a thread or a yarn. The second inlet 13 is connectable to a supply of fluid, for example a flavor material via a plug 24 (see FIG. 3). The outlet 16 is connectable to a needle 22 (see FIG. 3).

Figure 3:
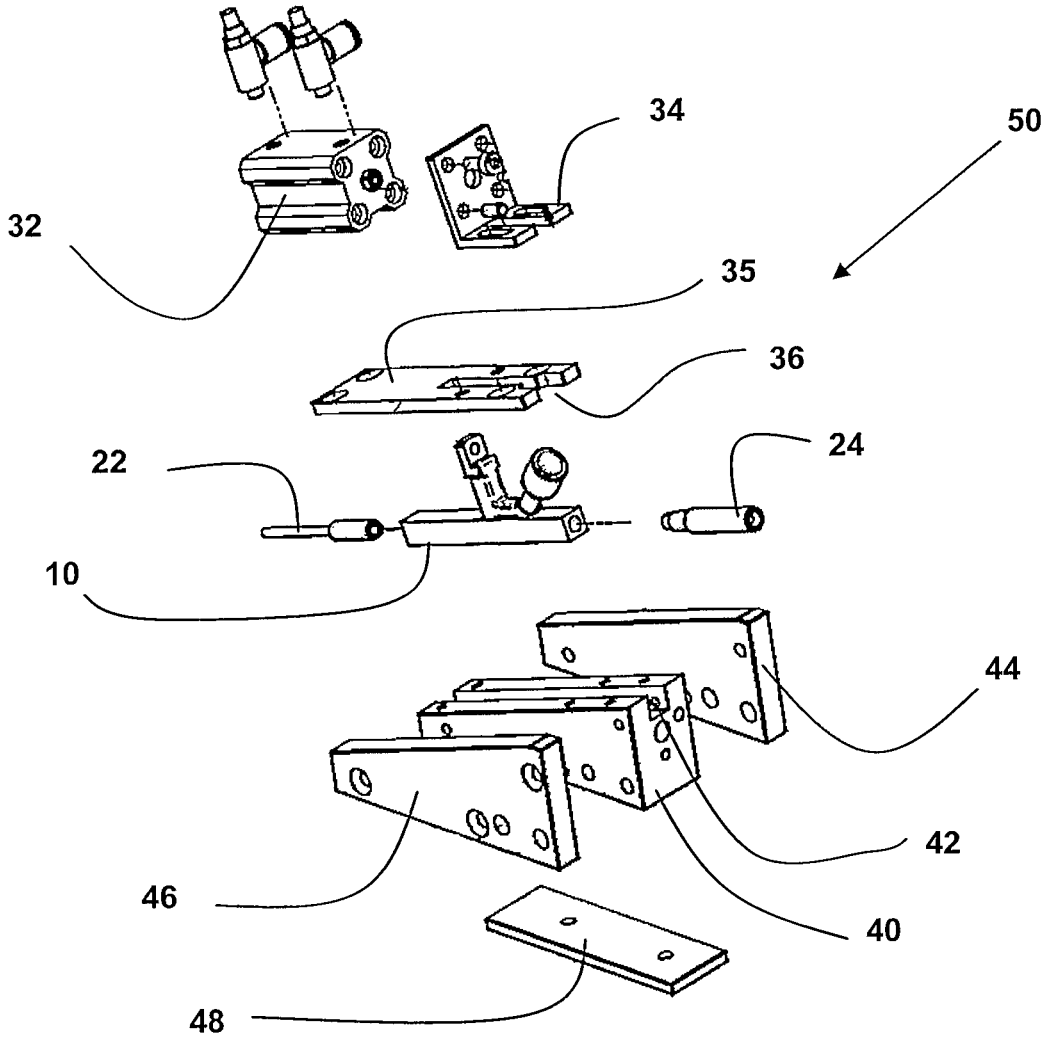
FIG. 3 illustrates an embodiment of the flavor element positioning device according to the invention in an exploded view.

As shown in FIG. 3, the passage element 10 is located in a block 40 inside a groove 42. The block 40 is flanked by first and second side walls 44, 46 and rests on a bottom plate 48. The passage element 10 is attached to a corner piece 34 through the hole 19 (see FIG. 2). The corner piece 34 is attached on one side to a drive 32, which has a fixed position in relation to the flavor element positioning device 50. On the other side, the corner piece 34 is connected through two long holes to a sliding plate 35. The two long holes are used to fine adjust the longitudinal position of the passage element 10. Fine adjustment of the passage element 10 is done in view of the fine adjustment of the tip of the attached needle 22 inside the filter tow.

The sliding plate 35 is guided by the first and second side walls 44, 46. The drive 32 is controlled such that the passage element 10 is movable along the groove 42 in order to move the attached needle 22 in and out of the moving tow. The drive 32 is a pneumatic piston. Alternatively, a stepper motor or similar drive may be used.

Figure 4:
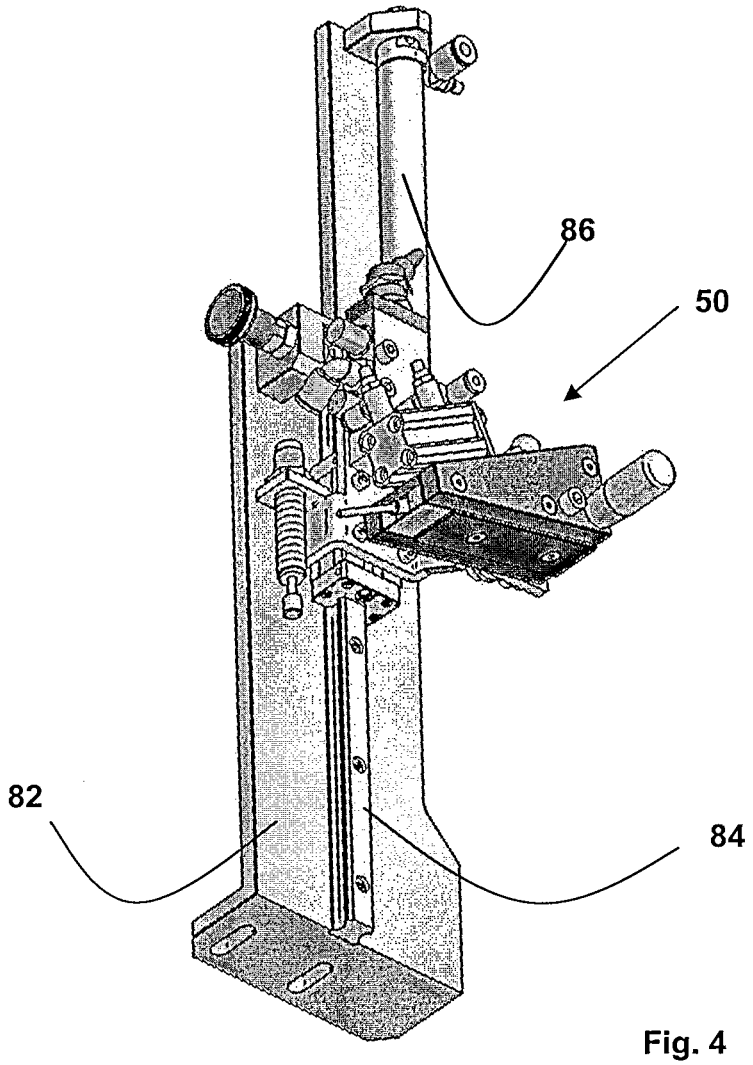
FIG. 4 illustrates an embodiment of the flavor element positioning device according to the invention with a vertical positioning device.

As shown in FIG. 4, the flavor element positioning device 50 is mounted on a vertical rail 84 on a base plate 82. A piston 86 is controlled such that the entire flavor element positioning device 50 is movable along the vertical rail 84 up and down. In the up position, the flavor element positioning device 50 is easily accessible for maintenance purposes. Together with the drive 32, the position of the end of the needle 22 in the moving tow is controllable longitudinally and vertically. In this embodiment, the longitudinal direction is slightly inclined with respect to the horizontal direction.

In use, either a continuous thread 7 is fed through the first inlet 11 into the passageway 17 or fluid is applied through the second inlet 13 into the passageway 17. Alternatively, a continuous thread 7 is fed through the first inlet 11 and fluid is applied through the second inlet 13 at the same time. Upon meeting at the junction 15, the continuous thread 7 is soaked with the fluid. The soaked continuous thread 7 then passes through the passageway 17, the needle 22 and into the moving tow. Due to the exact positioning of the end of the needle, the continuous thread 7 may be aligned centrally in the finished filter. Depending on the fluid flow rate, additional fluid may pass through the needle 22 into the moving filter tow.

The fluid may be heated by a heating device (not shown) before entering into the second inlet 13. The block 40 may comprise also a heating device (not shown). The fluid may be supplied in the form of granules that are melted by the heating device.

The second inlet 13 is controlled by means of a valve (not shown) to adjust the flow rate of the fluid and to prevent unwanted fluid entering the moving tow. The flow rate depends on the type of fluid, the speed of the filter tow and the power of the pump that advances the fluid. Preferably, the flow rate is adjusted with respect to the finished filter, such that the finished filter does not show spots on the tipping paper. The speed of the continuous thread 7 is adjusted to the speed of the filter tow, for example up to 10 meters per second.

Figure 5:
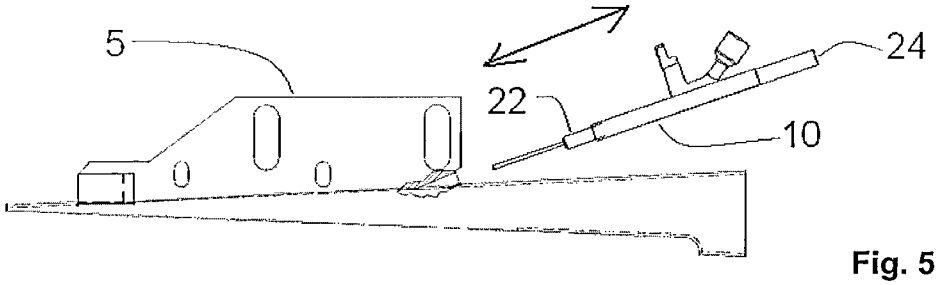
FIG. 5 shows the passage element of the flavor element positioning device according to an embodiment of the invention in relation to the filter making apparatus.

FIG. 5 shows the passage element 10 of the flavor element positioning device 50 in relation to the filter making apparatus 1. Preferably, the region in which the tip of the needle 22 is located in the filter material is the region, where the filter material is between about 140 and about 120 percent of its final diameter.

What is claimed is:

1. A filter making apparatus comprising:

a filter material converging device;

a flavor element positioning device including a passage element, the passage element having a passageway, a first inlet, a second inlet, and an outlet, the first inlet and second inlet being in fluid communication with the passageway, wherein the first inlet is adapted to pass a continuous strand of material into the passage element, wherein the second inlet is adapted to pass fluid into the passage element, and wherein the outlet is positioned at a point downstream from at least a portion of the filter material converging device;

wherein the passage element is adapted to pass through the second inlet and into the filter material either the continuous strand of material from the first inlet, or fluid from the second inlet, or the continuous strand of material from the first inlet together with fluid from the second inlet;

wherein the flavor element positioning device further includes a needle attached to the outlet of the passage element;

wherein the apparatus includes a pneumatic piston for longitudinally positioning the passage element in a longitudinal direction, such that the needle is movable in and out of the filter material; and wherein the apparatus includes a vertical positioning apparatus adapted to move the passage element in a vertical direction into and out of the vicinity of the filter material converging device, as well as to a maintenance position.

2. The filter making apparatus according to claim 1, wherein the fluid is a liquid flavorant.

3. The filter making apparatus according to claim 2, wherein the heating device is adapted to heat the fluid in the passage element.

4. The filter making apparatus according to claim 1, wherein the apparatus further comprises a heating device adapted to heat the fluid.

5. The filter making apparatus according to claim 1, wherein the apparatus further comprises a valve remote from the flavor element positioning device to control the fluid entering the passage element.

6. The filter making apparatus according to claim 1, wherein the needle includes a tip and the position of the tip of the needle is juxtaposed at the end of the filter converging device, where the filter material reaches its final shape.

7. The filter making apparatus according to claim 6, wherein the position of the tip of the needle is disposed in the filter converging device, where the passageway has a diameter less than double the diameter of the final shape of the filter material.

8. The filter making apparatus according to claim 6, wherein the position of the tip of the needle is disposed in the filter converging device, where the passageway has a diameter between about 150 percent and about 110 percent of the final diameter of the filter material.

9. The filter making apparatus according to claim 8, wherein the position of the tip of the needle is disposed in the filter converging device, where the passageway has a diameter between about 140 percent and about 120 percent of the final diameter of the filter material.

10. The filter making apparatus according to claim 1, wherein the filter making apparatus includes two to four flavor element positioning devices.

11. The filter making apparatus according to claim 10, wherein the two to four flavor element positioning devices are arranged such that two to four parallel, spaced apart, continuous strands of material may be applied to the filter material.

* * * * *